US006819048B2

(12) United States Patent
Stockwald

(10) Patent No.: US 6,819,048 B2
(45) Date of Patent: Nov. 16, 2004

(54) HIGH PRESSURE DISCHARGE LAMP HAVING A CERAMIC DISCHARGE VESSEL

(75) Inventor: Klaus Stockwald, Munich (DE)

(73) Assignee: Patent-Treuhand-Gesellschaft fuer elektrische Gluehlampen mbH, Munich (DE)

( * ) Notice: Subject to any disclaimer, the term of this patent is extended or adjusted under 35 U.S.C. 154(b) by 24 days.

(21) Appl. No.: 10/434,342

(22) Filed: May 9, 2003

(65) Prior Publication Data

US 2003/0214238 A1 Nov. 20, 2003

(30) Foreign Application Priority Data

May 16, 2002 (DE) ..... 102 22 254

(51) Int. Cl.[7] ..... H01J 61/30

(52) U.S. Cl. ..... 313/634; 313/570; 313/620; 313/621; 315/246; 315/248

(58) Field of Search ..... 3113/570, 573, 3113/574, 620, 621, 634; 315/155, 161, 246, 248

(56) References Cited

U.S. PATENT DOCUMENTS 4,594,529 A * 6/1986 de Vrijer ..... 313/571
4,742,268 A * 5/1988 Caruso et al. ..... 313/620
5,144,201 A * 9/1992 Graham et al. ..... 313/634
5,153,482 A * 10/1992 Keijser et al. ..... 313/634
5,998,940 A 12/1999 Takahashi et al.
6,400,076 B1 * 6/2002 Allen et al. ..... 313/572

FOREIGN PATENT DOCUMENTS

| | | |
|---|---|---|
| EP | 0 954 011 | 11/1999 |
| JP | 2001-197732 | 10/2001 |

* cited by examiner

*Primary Examiner*—Ashok Patel
(74) *Attorney, Agent, or Firm*—William E. Meyer

(57) ABSTRACT

The discharge volume has an internal length L and a maximum diameter D at its center, with the discharge vessel being equipped with a light-emitting filling and with two electrodes at the ends of the discharge vessel, with the lamp being operated by means of high frequency such that an acoustic longitudinal mode is formed, with the wall thickness varying along the length L of the discharge volume, with the wall thickness S being thinnest at the center of the discharge vessel, while it is at least 1.2 S at an optimum point Popt, with the optimum point in each case being at a distance of 7/24 L from the end of the discharge vessel.

8 Claims, 1 Drawing Sheet

HIGH PRESSURE DISCHARGE LAMP HAVING A CERAMIC DISCHARGE VESSEL

TECHNICAL FIELD

The invention is based on a high-pressure discharge lamp having a ceramic discharge vessel having a ceramic discharge vessel, with the discharge volume having an internal length L and a maximum diameter D at its center, with the discharge vessel being equipped with a light-emitting filling and with two electrodes at the ends of the discharge vessel, with the lamp being operated by means of a high frequency such that an acoustic longitudinal mode is formed. This relates in particular to metal halide lamps, which are operated at a frequency such that standing sound waves of a predetermined mode are produced.

PRIOR ART

A high-pressure discharge lamp having a ceramic discharge vessel which is operated with standing sound waves is already known from U.S. Pat. No. 5,998,940. The end of the discharge vessel has a wedged shape, which projects inward. The wall thickness is essentially constant.

A high-pressure discharge lamp in which the wall thickness of the ceramic discharge vessel increases toward the ends is known from JP-A 2001-297 732. However, in this case, standing acoustic waves are intended to be avoided.

A ceramic discharge vessel which is composed of two or more parts, with the end area being thickened for design reasons, is known from EP-A 954 011. This does not mention operation with acoustic modes.

DESCRIPTION OF THE INVENTION

One object of the present invention is to provide a high-pressure discharge lamp having a ceramic discharge vessel, with the discharge volume having an internal length L and a maximum diameter D at its center, with the discharge vessel being equipped with a light-emitting filling and with two electrodes at the ends of the discharge vessel, with the lamp being operated by means of a high frequency such that an acoustic longitudinal mode is formed, which has a longer life and is less susceptible to corrosion.

This object is achieved by the following features: the wall thickness varies along the length L of the discharge volume, with the wall thickness S being thinnest at the center of the discharge vessel, while it is at least 1.2 S at an optimum point Popt, with the optimum point in each case being at a distance of 7/24 L from the end of the discharge vessel.

Particularly advantageous refinements can be found in the dependent claims.

In the case of high-pressure discharge lamps which have a ceramic discharge vessel and which are operated in an acoustic mode, one area of the wall thickness at the end of the discharge vessel is, according to the invention, thickened.

During operation in operating states with acoustic longitudinal modes, which can lead to filling being deposited in the area of the sound wave bulges, filling deposits can occur on the inner wall of these zones. Long-term action, material wear and corrosion can occur in these zones, depending on the absolute temperature (typically 1350 K) and temperature gradient (typically 6–10 K/mm) as well as the amount of filling in the deposited metal halide mixture.

The wall thickening is at least 20% (typically between about 25% and 100%) of the wall thickness in the burner center. The wall thickening extends at least along L min=1/15 of the burner internal length IL, and is centered with respect to the burner axis about the positions 7/24×IL and 17/24×IL from one internal end surface of the burner interior. The definition of the internal end surface is: the internal end surface is that which results when the profile of the internal contour, when extended beyond the cylindrical section with the capillary diameter, intersects the capillary axis (important for curved internal end surfaces).

Broader localizations for wall thickening may be chosen depending on the purpose and the operating mode.

In particular, the discharge vessel is intended to have an aspect ratio of the internal length L to the maximum internal diameter D of A=L/D=2 to 6, since acoustic modes can then best be stimulated. In these cases, the wall thickness is designed to be thickened by from (0 to 1/3)*L and from (2/3 to 1)*L of the burner internal length.

So-called two-cell modes are typically used, with two acoustic cells being formed by a longitudinal acoustic standing sound wave of controlled intensity.

In this case, in a horizontal burning position, filling is deposited on two zones in the lamp, and is localized at a distance of between about 1/4 and 1/3 of the burner internal length from the inner ends.

In a vertical burning position, filling is likewise deposited at these points in the form of metal halide films and droplets in an annular shape over the circumference of the inner wall.

If the wall is locally thickened at this point (ring areas), these thickened areas on the one hand result in increased emission of IR radiation at these points (increase in the emissivity of the transluscent/transparent ceramic), while on the other hand the thermal resistance of the wall for heat flows decreases toward the burner ends and, furthermore, the greater wall thickness results in the life of the ceramic vessel being increased, and in the ceramic vessel being less susceptible to failure from corrosion.

In general, further multicell operating modes (that is to say higher modes) are possible which produce strip patterns, which are formed regularly and symmetrically from the ends, of filling deposits on the burner surface over lengthy burning periods. In general, discharge vessels which are operated with multicell modes can be modified in a comparable form.

Various embodiments which satisfy the fundamental idea can be produced depending on the shaping and production method of the burner vessels.

In this case, the thickening can extend as far as the burner ends, or else it can increase continuously toward the burner ends, as long as the condition according to the invention is still satisfied.

BRIEF DESCRIPTION OF THE DRAWINGS

The invention will be explained in more detail in the following text with reference to a number of exemplary embodiments. In the figures.

PREFERRED EMBODIMENT OF THE INVENTION

Figure 1:
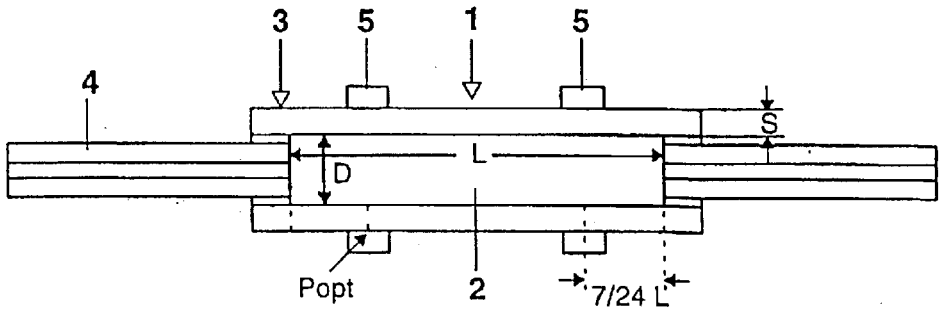
FIG. 1 shows a section through a high-pressure discharge lamp.

FIG. 1 shows the basic form of a ceramic discharge vessel 1. Typically, this has an integral cylindrical discharge volume 2 and elongated plugs 4 at the ends 3. According to the invention, annular thickened regions 5 are sintered on the outside onto the discharge vessel 1 for high-frequency operation with acoustic longitudinal modes. These have a wall thickness of 50% of the wall thickness of the discharge vessel (not shown to scale).

Figure 2:
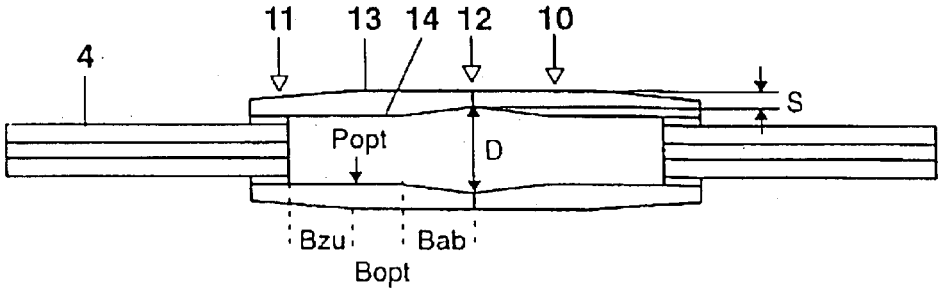
FIG. 2 shows a further exemplary embodiment of a high-pressure discharge lamp.
Figure 3:
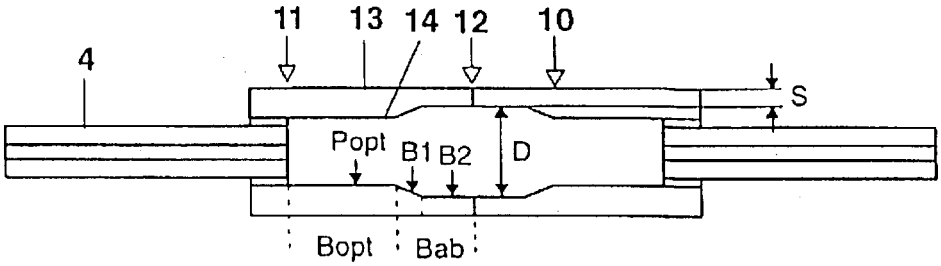
FIG. 3 shows a further exemplary embodiment of a high-pressure discharge lamp.
Figure 4:
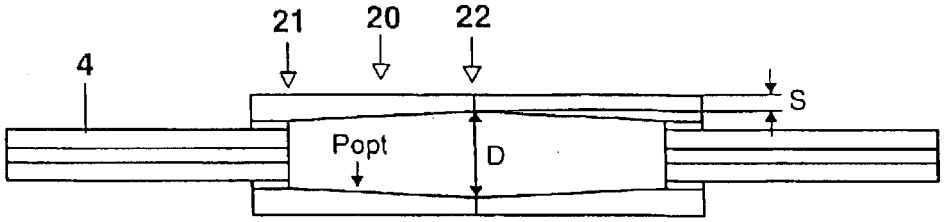
FIG. 4 shows a further exemplary embodiment of a high-pressure discharge lamp.

Ceramic discharge vessels which can be produced using injection molding or slip casting methods are shown in FIGS. 2 to 4.

In detail, FIG. 2 shows a two-part discharge vessel 10, in which the wall thickness varies continuously. Initially, it increases linearly from the end 11 of the discharge vessel toward the center 12, which is represented by the seam point, with this being characterized as the area Bzu in FIG. 2, with the outer wall 13 being correspondingly chamfered. It is constant in an adjacent area of maximum optimum thickness, Bopt. The wall thickness then decreases again in the direction of the center of the discharge vessel, as is characterized by the area Bab in FIG. 2, to be precise by the inner wall 14 now being chamfered appropriately. The area Bopt has a minimum length of 1/15 L. In each case, it includes the point Popt, whose distance from the end of the discharge vessel is 7/24 L.

This description applies equally to both halves of the discharge vessel, in each case seen in mirror-image form.

FIG. 3 shows an exemplary embodiment in which the above condition is satisfied by the fact that the area Bzu and the area Bopt have the same constant wall thickness, while the area Bab is provided by an area B1 with a chamfered inner wall and by a central area B2 with a reduced constant wall thickness.

Investigations into the relationship between the emissivity in the IR and the transluscent polycrystalline alumina ceramic as a function of the thickness and temperature have shown that an increase in the wall thickness from about 0.7 mm to 1.3 mm leads to a change in the emission coefficients from 0.23 to 0.27 (an increase of 17%). The IR emission thus likewise changes locally by about 17%. This results in considerably more cooling at these wall locations, which leads to slower chemical reaction rates and to considerably longer life. Typical cold spot temperatures on the ceramic discharge vessels are 1300 to 1400 K.

Finally, FIG. 4 shows a discharge vessel 20 in which the wall thickness decreases continuously from the ends 21 toward the center 22. In this case, the point Popt satisfies the optimum condition according to the invention.

What is claimed is:

1. A high-pressure discharge lamp having a ceramic discharge vessel, with the discharge volume having an internal length L and a maximum diameter D at its center, with the discharge vessel being equipped with a light-emitting filling and with two electrodes at the ends of the discharge vessel, with the lamp being operated by means of a high frequency such that an acoustic longitudinal mode is formed, wherein the wall thickness varies along the length L of the discharge volume, with the wall thickness S being thinnest at the center of the discharge vessel, while it is at least 1.2 S at an optimum point Popt, with the optimum point in each case being at a distance of 7/24 L from the end of the discharge vessel.

2. The high-pressure discharge lamp as claimed in claim 1, wherein the optimum point Popt is surrounded by an area Bopt having at least the same wall thickness which has a length of at least 1/15L.

3. The high-pressure discharge lamp as claimed in claim 1, wherein the thickened wall thickness is provided by means of a ring part sintered on the outside.

4. The high-pressure discharge lamp as claimed in claim 1, wherein the thickened wall thickness is provided by the contour shape of the inner wall and/or of the outer wall of the discharge vessel.

5. The high-pressure discharge lamp as claimed in claim 4, wherein the discharge vessel, seen from the ends toward the center, has an area (Bzu) on the outside of increasing wall thickness, an area of constant wall thickness (Bopt) and an area (Bab) on the inside of decreasing wall thickness.

6. The high-pressure discharge lamp as claimed in claim 4, wherein the discharge vessel, seen from the ends toward the center, has an area of constant wall thickness (Bopt) and, on the inside, of decreasing wall thickness (Bab).

7. The high-pressure discharge lamp as claimed in claim 4, wherein the discharge vessel, seen from the ends toward the center, has a constantly decreasing wall thickness.

8. The high-pressure discharge lamp as claimed in claim 1, characterized in that the ratio L/D is in the range L/D=2 to 6.

* * * * *